US009264811B1

(12) United States Patent
Yaberg et al.

(10) Patent No.: US 9,264,811 B1
(45) Date of Patent: Feb. 16, 2016

(54) EQ CORRECTION FOR SOURCE DEVICE IMPEDANCE AND OUTPUT DEVICE IMPEDANCE INTERACTIONS

(71) Applicants: Tyson Osborne Yaberg, Camarillo, CA (US); Tyrone Chen, Rancho Palos Verdes, CA (US)

(72) Inventors: Tyson Osborne Yaberg, Camarillo, CA (US); Tyrone Chen, Rancho Palos Verdes, CA (US)

(73) Assignee: AUDYSSEY LABORATORIES, Los Angeles, CA (US)

( * ) Notice: Subject to any disclaimer, the term of this patent is extended or adjusted under 35 U.S.C. 154(b) by 129 days.

(21) Appl. No.: 14/254,069

(22) Filed: Apr. 16, 2014

(51) Int. Cl.
*H04R 3/04* (2006.01)

(52) U.S. Cl.
CPC ..... *H04R 3/04* (2013.01)

(58) Field of Classification Search
CPC ..... H04R 3/04–3/10
See application file for complete search history.

(56) References Cited

U.S. PATENT DOCUMENTS

| | | | | |
|---|---|---|---|---|
| 4,079,198 | A | 3/1978 | Bennett | |
| 5,043,970 | A | 8/1991 | Holman | |
| 5,553,151 | A | 9/1996 | Goldberg | |
| 5,917,916 | A | 6/1999 | Sibbald et al. | |
| 2003/0179891 | A1 | 9/2003 | Rabinowitz et al. | |
| 2004/0002781 | A1 | 1/2004 | Johnson | |
| 2004/0042625 | A1* | 3/2004 | Brown | H04R 3/04 381/103 |
| 2005/0105741 | A1 | 5/2005 | Niederdrank et al. | |
| 2007/0286441 | A1 | 12/2007 | Harsch et al. | |
| 2008/0137873 | A1 | 6/2008 | Goldstein | |
| 2008/0181424 | A1 | 7/2008 | Schulein et al. | |
| 2009/0274312 | A1* | 11/2009 | Howard | H04R 29/003 381/58 |
| 2012/0281845 | A1 | 11/2012 | Siotis | |
| 2014/0369519 | A1* | 12/2014 | Leschka | H03G 5/165 381/74 |

FOREIGN PATENT DOCUMENTS

| | | | |
|---|---|---|---|
| EP | 1 415 592 | A1 | 6/2004 |
| EP | 1 594 344 | A2 | 9/2005 |

* cited by examiner

*Primary Examiner* — Sonia Gay
(74) *Attorney, Agent, or Firm* — Kenneth L. Green; Averill & Green

(57) ABSTRACT

A software-based equalization method corrects for effects of impedance interactions of a source device and an output device, on an aggregate frequency response, in audio playback of a system. The correction results in perceived sound remaining consistent from any source device and output device combination. The method does not require any hardware modifications and a cloud-based database of source devices and output devices provides corrections for a wide array of possible device pairings.

10 Claims, 3 Drawing Sheets

EQ CORRECTION FOR SOURCE DEVICE IMPEDANCE AND OUTPUT DEVICE IMPEDANCE INTERACTIONS

BACKGROUND OF THE INVENTION

The present invention relates to correcting the frequency response of audio devices and in particular to correcting a frequency response which has been altered by interactions of impedances of an acoustic source device and output device combination.

Interaction between the impedance of an acoustic source device and an output device has been found to alter the frequency response in headphones, and other audio devices. The impedance interaction may prevent a consistent perception of sound when listening to any given output device connected to any given source device.

The impedance interaction problem is known in the audio industry. The known solutions propose changes to the electrical or acoustical design of either the source device or the output device. No known software-based impedance interaction problem solutions are available.

BRIEF SUMMARY OF THE INVENTION

The present invention addresses the above and other needs by providing a software-based equalization method which corrects for the effects in an aggregate frequency response of a system caused by impedance interactions of a source device and an output device. The correction results in perceived sound remaining consistent from any source device and output device combination. The method does not require any hardware modifications and a cloud-based or locally stored database of source devices and output devices provides corrections for a wide array of possible device pairings.

In accordance with one aspect of the invention, there is provided a software-based equalization method for correcting source device impedance and output device impedance interactions requiring no modification to hardware.

In accordance with another aspect of the invention, there is provided a software-based equalization method for correcting source device impedance and output device impedance interactions for a multiplicity of source and output device pairings. The method includes a library of source and output device pairings stored in a cloud-based or locally stored database and provided to uses as needed.

In accordance with still another aspect of the invention, there is provided a software-based equalization method for correcting source device impedance and output device impedance interactions. The method is applicable to any source device and output device pairing with impedances which cause perceived differences in the combined acoustic responses.

In accordance with yet another aspect of the invention, there is provided a software-based equalization method. The method includes the steps of measuring the complex impedance of the source device, measuring the complex impedance of the output device, determining the frequency response of the interaction between the source device and the output device based on the measured impedances, generating an inverse equalization of the frequency response, and applying the inverse equalization to the audio signal in the source device, or in the audio stream being played through the source device.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
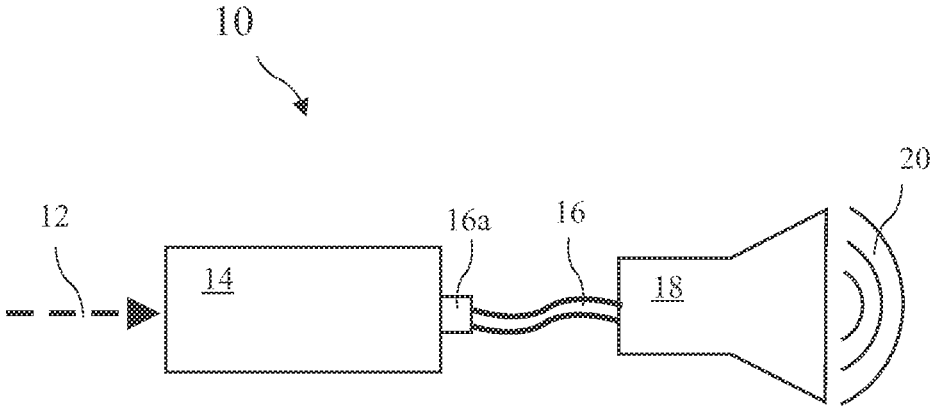
FIG. 1 shows an audio system including a source device and an output device according to the present invention.

An audio system including a source device 14, (for example, a smartphone or other portable electric device), and an output device 18 (for example, a speaker, headphones, or other transducers), are shown in FIG. 1. The source device 14 receives signals 12 or plays a locally stored signal (i.e., a song stored on an iPod is not received by the device 14, but is played on or from the device 14), processes and amplifies the signals 12, and provides the amplified signals to the output device 18 through second cables 16. The output device 18 then produces sound waves 20. Such source device 14 inherently includes a complex output impedance. The output impedance resulting from the output amplifier stage varies widely among different devices and designs ranging from about 0 ohms to over 120 ohms.

The output device 18 imparts a frequency dependent load (impedance). The pairing of the output device 18 load impedance with a source device 14 output impedance creates a frequency-dependent voltage divider, which voltage divider divides the voltage at every frequency, and therefore the power at every frequency, between the source device 14 and output device 18. The formula for this frequency-dependent voltage divider is:

$$V_{out}(f) = \frac{Z_{output\ device}(f)}{Z_{output\ device}(f) + Z_{source\ device}(f)} V_{in}(f)$$

where V and Z represent voltage and impedance, respectively, and f is the frequency.

As different voltages are delivered to the output device 18 at different frequencies, the Sound Pressure Level (SPL) of the sound waves 20 produced by the output device 18 at those frequencies varies. The SPL response of the output device 18 varies by frequency as the load impedance varies by frequency when the output impedance is nonzero. Since the impedance of most audio output devices 18 can vary significantly with frequency, the resulting SPL variations for a given output and source device pairing can be vary significant, as much as 6 dB. The equalization according to the present invention applied through software adjusts this change in frequency response to maintain a consistent acoustic frequency response across device pairings.

Figure 2:
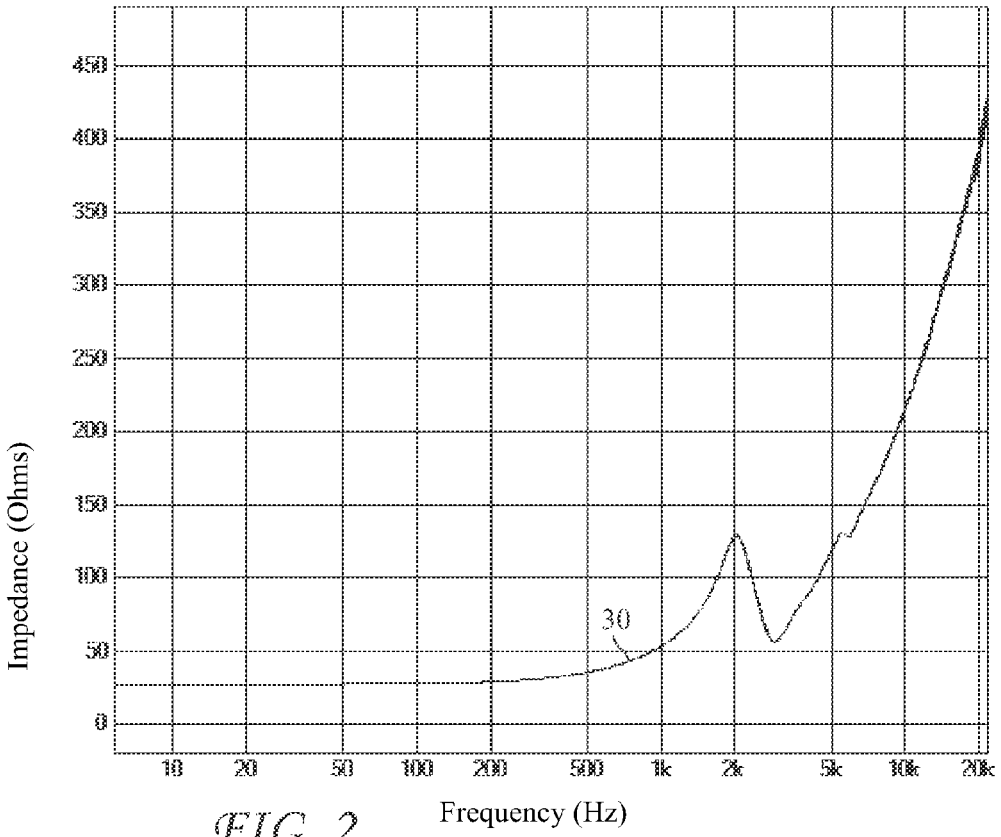
FIG. 2 shows the variation of impedance as a function of frequency of an output device.
Figure 3:
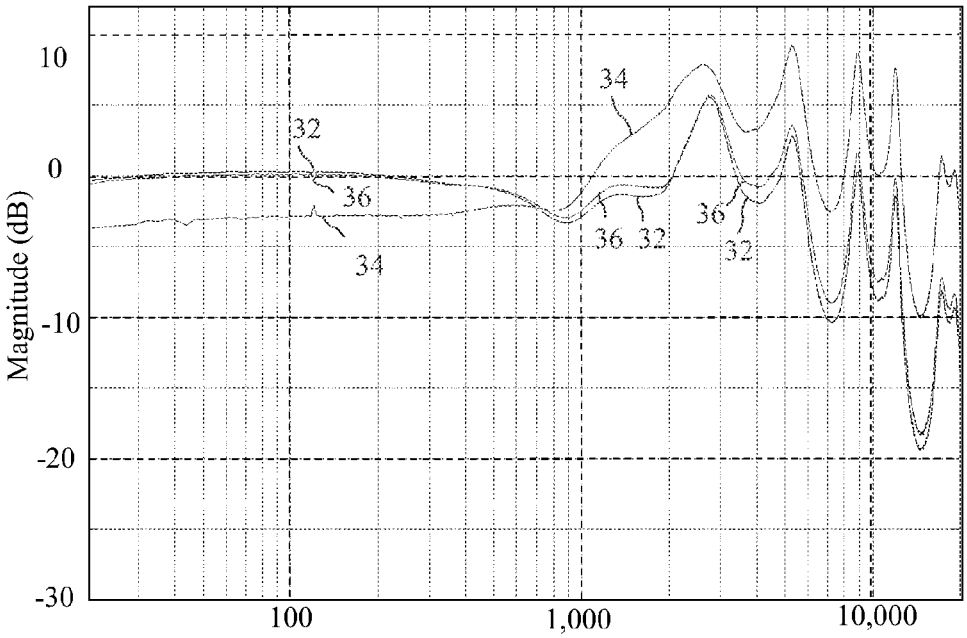
FIG. 3 shows the frequence response of corrected and uncorrected systems.

Through measuring the complex impedance for the source device 14 and output device 18 across the frequency range of human hearing (typically 20 Hz to 20,000 Hz), the change in frequency response can be determined through analysis of the applied frequency-dependent voltage divider for a given device pairing. For example, a pair of MEElectronics A151 headphones with a frequency-dependent impedance 30 shown in FIG. 2 varies from ~25 ohms to ~425 ohms played out of a source device with a ~1 ohm output impedance will have a frequency response 32 differing by upwards of 6 dB SPL at certain frequencies compared to the frequency response 34 of the same headphones played out of a source device with a ~103 ohm output impedance. Through modeling the effect of the voltage divider, the frequency response of the interaction is determined, and the inverse EQ of this response is generated. This inverse response is applied through software running on the source device, or on the audio stream being played through the source device, to ensure consistent acoustic responses 36 across differing devices which is very close to the frequency response 32.

Figure 4:
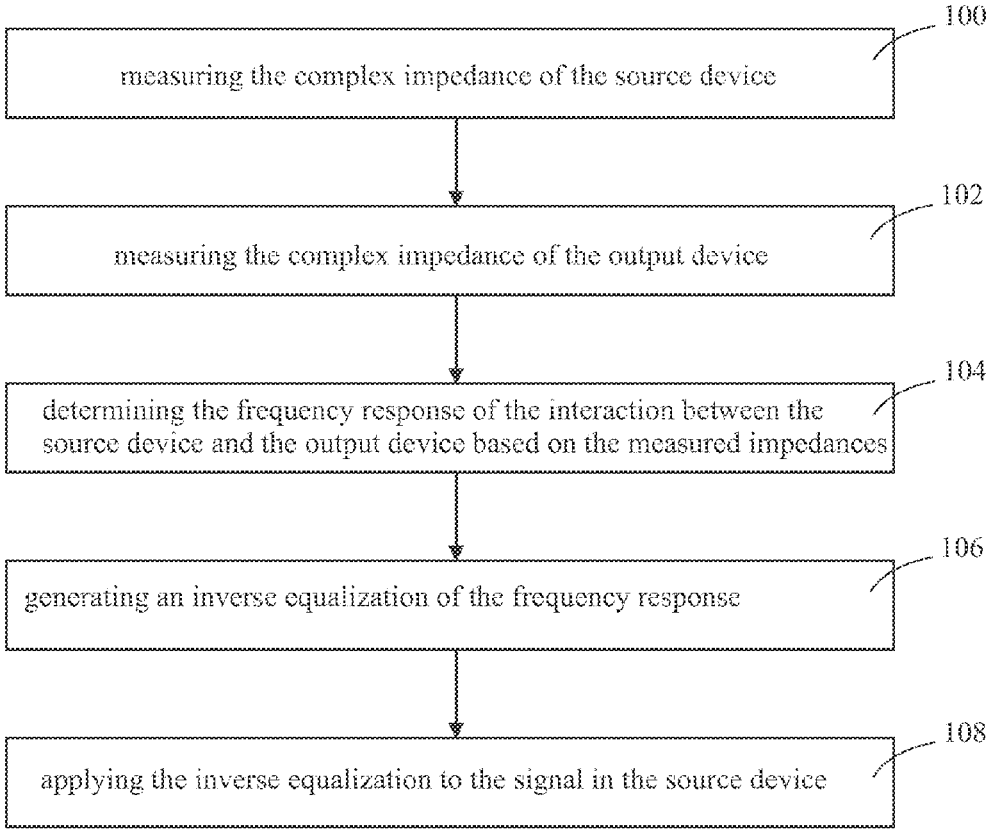
FIG. 4 is a method according to the present invention.

A method according to the present invention is shown in FIG. 4. The method includes the steps of measuring the complex impedance of the source device at step 100, measuring the complex impedance of the output device at step 102, determining the frequency response of the interaction between the source device and the output device based on the measured impedance at step 104, generating an inverse equalization of the frequency response at step 106, and applying the inverse equalization to the signal in the source device at step 108. Those skilled in the art will recognize that processing of the inverse filter does not necessarily have to be applied by the source device and could be done in the cloud or another stage of processing, and methods performing the inverse filter processing at other stages of processing are intended to come within the scope of the present invention. Further, the inverse equalization may be pre-loaded into the source device or downloaded from a database, for example, a cloud-based database. Such database may include a library of inverse equalizations for a multiplicity of source and output device pairings provided to uses as needed.

While the invention herein disclosed has been described by means of specific embodiments and applications thereof, numerous modifications and variations could be made thereto by those skilled in the art without departing from the scope of the invention set forth in the claims.

We claim:

1. A method for correcting interactions between source device and output device impedances, the method comprising:

measuring the complex impedance of the source device;

measuring the complex impedance of the output device;

determining the frequency response of the interaction between the source device and the output device based on the measured impedances by modeling the frequency response of the interaction between the source device and the output device as a frequency-dependent voltage divider;

generating an inverse equalization of the frequency response;

applying the inverse equalization to a signal processed by the source device to produce a processed signal;

providing the processed signal to the output device; and transducing the processed signal into sound waves by the output device.

2. The method of claim 1, wherein determining the frequency response of the interaction between the source device and the output device based on the measured impedances comprise determining the frequency response $V_{out}(f)$ using an equation:

$$V_{out}(f) = \frac{Z_{output\ device}(f)}{Z_{output\ device}(f) + Z_{source\ device}(f)} V_{in}(f)$$

3. The method of claim 1, wherein the source device is a smartphone.

4. The method of claim 1, wherein the inverse equalization is stored in the source device.

5. The method of claim 1, wherein the inverse equalization is stored in a database including a library of inverse equalizations for a multiplicity of source and output device pairings provided to uses as needed.

6. The method of claim 4, wherein the database is a cloud-based database.

7. The method of claim 1, wherein applying the inverse equalization to a signal processed by the source device comprises applying the inverse equalization to a signal in the source device.

8. The method of claim 1, wherein applying the inverse equalization to a signal processed by the source device comprises applying the inverse equalization to a signal before providing the signal to the source device.

9. A method for correcting interactions between source device and output device impedances, the method comprising:

measuring the complex impedance of the source device;

measuring the complex impedance of the output device;

modeling the frequency response of the interaction between the source device and the output device as a frequency-dependent voltage divider;

generating an inverse equalization of the frequency response;

applying the inverse equalization to a signal processed by the source device to produce a processed signal;

providing the processed signal to the output device; and transducing the processed signal into sound waves by the output device.

10. A method for correcting interactions between source device and output device impedances, the method comprising:

measuring the complex impedance of the source device;

measuring the complex impedance of the output device;

modeling the frequency response of the interaction between the source device and the output device as a frequency-dependent voltage divider using the equation:

$$V_{out}(f) = \frac{Z_{output\ device}(f)}{Z_{output\ device}(f) + Z_{source\ device}(f)} V_{in}(f)$$

generating an inverse equalization of the frequency response;

applying the inverse equalization to a signal processed in the source device to produce a processed signal;

providing the processed signal to the output device; and transducing the processed signal into sound waves by the output device.

* * * * *